US009920393B2

(12) United States Patent
Zaizen et al.

(10) Patent No.: US 9,920,393 B2
(45) **Date of Patent: *Mar. 20, 2018**

(54) METHOD OF PRODUCING NON-ORIENTED ELECTRICAL STEEL SHEET

(71) Applicant: JFE STEEL CORPORATION, Tokyo (JP)

(72) Inventors: Yoshiaki Zaizen, Tokyo (JP); Yoshihiko Oda, Tokyo (JP); Hiroaki Toda, Tokyo (JP); Tadashi Nakanishi, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 517 days.

This patent is subject to a terminal disclaimer.

(21) Appl. No.: 14/385,397

(22) PCT Filed: Mar. 7, 2013

(86) PCT No.: PCT/JP2013/056228

§ 371 (c)(1),
(2) Date: Sep. 15, 2014

(87) PCT Pub. No.: WO2013/137092

PCT Pub. Date: Sep. 19, 2013

(65) Prior Publication Data

US 2015/0059929 A1 Mar. 5, 2015

(30) Foreign Application Priority Data

Mar. 15, 2012 (JP) ..... 2012-058429

(51) Int. Cl.

| | |
|---|---|
| ***C21D 9/46*** | (2006.01) |
| ***C21D 8/12*** | (2006.01) |
| ***C22C 38/06*** | (2006.01) |
| ***H01F 1/16*** | (2006.01) |
| ***C22C 38/00*** | (2006.01) |
| ***C22C 38/02*** | (2006.01) |
| ***C22C 38/04*** | (2006.01) |
| ***C21D 6/00*** | (2006.01) |
| ***C22C 38/60*** | (2006.01) |

(52) U.S. Cl.

CPC ..... *C21D 9/46* (2013.01); *C21D 6/005* (2013.01); *C21D 6/008* (2013.01); *C21D 8/12* (2013.01); *C21D 8/1222* (2013.01); *C21D 8/1233* (2013.01); *C21D 8/1261* (2013.01); *C21D 8/1272* (2013.01); *C22C 38/001* (2013.01); *C22C 38/002* (2013.01); *C22C 38/004* (2013.01); *C22C 38/008* (2013.01); *C22C 38/02* (2013.01); *C22C 38/04* (2013.01); *C22C 38/06* (2013.01); *C22C 38/60* (2013.01); *H01F 1/16* (2013.01)

(58) Field of Classification Search

CPC ..... C21D 9/46

See application file for complete search history.

(56) References Cited

U.S. PATENT DOCUMENTS

| | | | | |
|---|---|---|---|---|
| 3,935,038 | A | 1/1976 | Shimoyama et al. | |
| 3,948,691 | A * | 4/1976 | Matsushita | C21D 8/1205 148/111 |
| 4,661,174 | A | 4/1987 | Miyoshi et al. | |
| 4,898,627 | A | 2/1990 | Schoen | |
| 5,955,201 | A | 9/1999 | Loudermilk et al. | |
| 6,139,650 | A | 10/2000 | Oda et al. | |
| 7,011,139 | B2 | 3/2006 | Schoen et al. | |
| 2007/0062611 | A1 | 3/2007 | Murakami | |
| 2013/0146187 | A1 | 6/2013 | Zaizen et al. | |
| 2013/0263981 | A1 | 10/2013 | Zaizen et al. | |
| 2015/0059929 | A1 | 3/2015 | Zaizen et al. | |
| 2015/0357101 | A1* | 12/2015 | Zaizen | C21D 8/12 148/111 |
| 2016/0273064 | A1 | 9/2016 | Kataoka et al. | |

FOREIGN PATENT DOCUMENTS

| | | |
|---|---|---|
| EP | 0866144 | 9/1998 |
| JP | 55-158252 | 12/1980 |
| JP | 62-180014 | 8/1987 |
| JP | 64-004455 | 1/1989 |
| JP | H02-11728 | 1/1990 |
| JP | 03-126845 | 5/1991 |

(Continued)

OTHER PUBLICATIONS

English Machine Translation of JP 2005-200755 A of Fujimura, Hiroshi et al. published Jul. 28, 2005.*
Japanese Office Action dated Oct. 7, 2015, with English Translation; Application No. 2012-058429.
International Search Report, PCT/JP2013/056228, dated Jun. 11, 2013, dated Jan. 4, 2017.
Chinese Office Action, dated May 11, 2015, in corresponding Chinese Patent Application No. 201380011687.2.
Extended European search report, dated Apr. 8, 2015, in corresponding European Patent Application No. 13761949.0.
Office Action from corresponding U.S. Appl. No. 13/992,011 dated Dec. 4, 2014.

(Continued)

*Primary Examiner* — Roy V King
*Assistant Examiner* — Jophy S. Koshy
(74) *Attorney, Agent, or Firm* — Young & Thompson

(57) ABSTRACT

A non-oriented electrical steel sheet having a high magnetic flux density and a low iron loss is produced by hot rolling a steel slab comprising C: not more than 0.005 mass %, Si: not more than 4 mass %, Mn: 0.03-3 mass %, Al: not more than 3 mass %, P: 0.03-0.2 mass %, S: present at not more than 0.005 mass %, N: not more than 0.005 mass %, Ca: 0.0005-0.01 mass %, provided that an atom ratio of Ca to S ((Ca mass %/40)/(S mass %/32)) is within a range of 0.5-3.5, and the balance being Fe and incidental impurities, hot band annealing, cold rolling, and then conducting recrystallization annealing by heating at an average temperature rising rate of not less than 100° C/s up to at least 740° C.

4 Claims, 3 Drawing Sheets

(56) References Cited

FOREIGN PATENT DOCUMENTS

| | | |
|---|---|---|
| JP | H03-223424 | 10/1991 |
| JP | H05-005126 | 1/1993 |
| JP | H05-214444 | 8/1993 |
| JP | H06-043614 | 6/1994 |
| JP | 06-51889 | 7/1994 |
| JP | 06-228645 | 8/1994 |
| JP | H06-228644 | 8/1994 |
| JP | 11335793 | 12/1999 |
| JP | 2001-158949 | 6/2001 |
| JP | 2001-316729 | 11/2001 |
| JP | 2001-323344 | 11/2001 |
| JP | 2001323347 | 11/2001 |
| JP | 2004-332042 | 11/2004 |
| JP | 2005-200755 | 7/2005 |
| JP | 2005-206887 | 8/2005 |
| JP | 2007-046104 | 2/2007 |
| JP | 2007-217744 | 8/2007 |
| JP | 2008-127600 | 6/2008 |
| JP | 2008-150697 | 7/2008 |
| JP | 2008-231504 | 10/2008 |
| JP | 2011236486 | 11/2011 |
| JP | 2012-046806 | 3/2012 |
| JP | 2012-149337 | 8/2012 |
| JP | 2013-010982 | 1/2013 |
| WO | 2012/029621 | 3/2012 |
| WO | 2013/137092 | 9/2013 |

OTHER PUBLICATIONS

Office Action from corresponding U.S. Appl. No. 13/992,011 dated May 21, 2015.

Advisory Action and Examiner-Initiated Interview Summary for corresponding U.S. Appl. No. 13/992,011 dated Sep. 1, 2015.

Office Action for corresponding U.S. Appl. No. 13/992,011 dated Nov. 4, 2015.

Final Office Action for corresponding U.S. Appl. No. 13/992,011 dated May 13, 2016.

Advisory Action for corresponding U.S. Appl. No. 13/992,011 dated Aug. 25, 2016.

Office Action from corresponding U.S. Appl. No. 14/761,538 dated Dec. 19, 2016.

United States Official Action—U.S. Appl. No. 14/761,538—dated Jul. 14, 2017.

* cited by examiner

C : 0.0025mass%, Si : 3.0mass%, Mn : 0.10mass%, Al:0.001mass%, N : 0.0019mass%, S : 0.0020mass%, Ca : 0.0025mass%, Ca/S : 1.0

C : 0.0025mass%, Si : 3.0mass%, Mn : 0.10mass%, Al:0.001mass%, N : 0.0019mass%, S : 0.0020mass%, Ca : 0.0025mass%, Ca/S : 1.0

C : 0.0028mass%, Si : 3.3 mass%, Mn : 0.50 mass%, Al : 0.004mass%, N : 0.0022 mass%, P : 0.08 mass%, S : 0.0024 mass%

C : 0.0028 mass%, Si : 3.3mass%% Mn : 0.50mass%, Al : 0.004mass%, N : 0.0022mass%, P : 0.08mass%, S : 0.0024mass%

C : 0.0025mass%, Si : 2.5mass%, Mn : 0.20mass%,
Al : 0.001mass%, N : 0.0025mass%, S : 0.0020mass%,
P : 010mass%, Ca : 0.0030mass%, Ca/S : 1.2

C : 0.0025 mass%, Si : 2.5mass%, Mn : 0.20mass%,
Al : 0.001mass%, N : 0.0025mass%, S : 0.0020mass%,
P : 010mass%, Ca : 0.0030mass%, Ca/S : 1.2

METHOD OF PRODUCING NON-ORIENTED ELECTRICAL STEEL SHEET

TECHNICAL FIELD

This invention relates to a method of producing a non-oriented electrical steel sheet, and more particularly to a method of producing a non-oriented electrical steel sheet with a high magnetic flux density and a low iron loss.

RELATED ART

Recently, it is strongly desired to attain a high efficiency and a miniaturization even in the field of electrical equipment in the global trend for reducing various consumption energies including electric power. Since non-oriented electrical steel sheets are widely used as a core material of the electrical equipment, in order to attain the high efficiency and miniaturization of the electrical equipment, it is necessary to attain high quality of the non-oriented electrical steel sheet, i.e. high magnetic flux density and low iron loss thereof.

In order to meet the above needs to the non-oriented electrical steel sheet, it has hitherto been attempted to enhance a specific resistance by adding an element mainly enhancing an electric resistance such as Si, Al or the like, or to reduce an iron loss by decreasing a sheet thickness to reduce eddy current loss.

In the non-oriented electrical steel sheet, it is attempted to attain the high magnetic flux density by coarsening crystal grain size before cold rolling or optimizing a cold rolling reduction in addition to the above methods. Because, copper loss resulted from passage of an electric current through a coil wound on the core cannot be disregarded in a rotary machine or a small-size transformer, in order to reduce the copper loss, it is effective to use a high magnetic flux density material capable of attaining the same magnetic flux density at a lower excitation current.

Therefore, it is considered that if there could be developed non-oriented electrical steel sheets having a high magnetic flux density and a low iron loss, they can largely contribute to attain the high efficiency or miniaturization of the electrical equipment. For example, as a method of producing such a non-oriented electrical steel sheet with the high magnetic flux density and low iron loss, Patent Document 1 discloses a technique of reducing the iron loss by adding 0.03-0.40% of Sn to a steel containing 0.1-3.5% of Si, and Patent Document 2 discloses a technique wherein a non-oriented electrical steel sheet having a low iron loss and a high magnetic flux density is obtained by adding a combination of Sn and Cu to develop magnetically desirable {100} and {110} textures and suppress an undesirable {111} texture.

PRIOR ART DOCUMENTS

Patent Documents

Patent Document 1: JP-A-555-158252
Patent Document 2: JP-A-562-180014

SUMMARY OF THE INVENTION

Task to be Solved by the Invention

By applying the techniques disclosed in Patent Documents 1 and 2 can be improved primary recrystallization texture to provide excellent magnetic properties. However, the demand for attaining the high quality becomes more severer from the users, and such a recent demand cannot be sufficiently met only by the above techniques.

The invention is made in view of the above problems in the conventional techniques and is to propose a method of producing a non-oriented electrical steel sheet with a high magnetic flux density and a low iron loss.

Solution for Task

The inventors have made various studies for solving the above task. As a result, it has been found out that a non-oriented electrical steel sheet with a high magnetic flux density and a low iron loss can be obtained stably by conducting heating at a temperature rising rate faster than the conventional value when a cold rolled steel sheet containing proper addition amounts of P and Ca is subjected to recrystallization annealing (finishing annealing), and the invention has been accomplished.

The invention is based on the above knowledge and proposes a method of producing a non-oriented electrical steel sheet, which comprises hot rolling a steel slab comprising C: not more than 0.005 mass %, Si: not more than 4 mass %, Mn: 0.03-3 mass %, Al: not more than 3 mass %, P: 0.03-0.2 mass %, S: present at not more than 0.005 mass %, N: not more than 0.005 mass %, Ca: 0.0005-0.01 mass %, provided that an atom ratio of Ca to S ((Ca mass %/40)/(S mass %/32)) is within a range of 0.5-3.5, and the balance being Fe and incidental impurities, hot band annealing, cold rolling and then conducting recrystallization annealing by heating at an average temperature rising rate of not less than 100° C./s up to at least 740° C.

The steel slab in the production method of the non-oriented electrical steel sheet of the invention is characterized by further containing one or two selected from Sn and Sb in each amount of 0.003-0.5 mass % in addition to the above chemical composition.

Effect of the Invention

According to the invention can be stably provided the non-oriented electrical steel sheet having excellent magnetic properties, so that it largely contributes to particularly attain high efficiency or miniaturization of an electrical equipment such as a rotary machine, a small size transformer or the like.

EMBODIMENTS FOR CARRYING OUT THE INVENTION

At first, the following experiment is carried out in order to investigate an influence of P content upon magnetic properties.

A steel slab containing C: 0.0025 mass %, Si: 3.0 mass %, Mn: 0.10 mass %, Al: 0.001 mass %, N: 0.0019 mass %, S: 0.0020 mass %, Ca: 0.0025 mass % and P: content varied within a range of 0.01-0.5 mass % is reheated at 1100° C. for 30 minutes and hot rolled to provide a hot rolled steel sheet of 2.0 mm in thickness, which is subjected to a hot band annealing of 1000° C.×30 seconds and to a single cold rolling to provide a cold rolled steel sheet of 0.35 mm in thickness. Then, the cold rolled steel sheet is subjected to a finishing annealing (recrystallization annealing) by heating in a direct-conducting heating furnace up to 740° C. at a temperature rising rate of two levels of 30° C./s and 200° C./s, further raising the temperature up to 1000° C. at 30° C./s, keeping this temperature for 10 seconds and thereafter cooling. Moreover, steel sheets having P contents of 0.35 mass % and 0.5 mass % are broken during the cold rolling, so that they are not used at subsequent steps.

Figure 1:
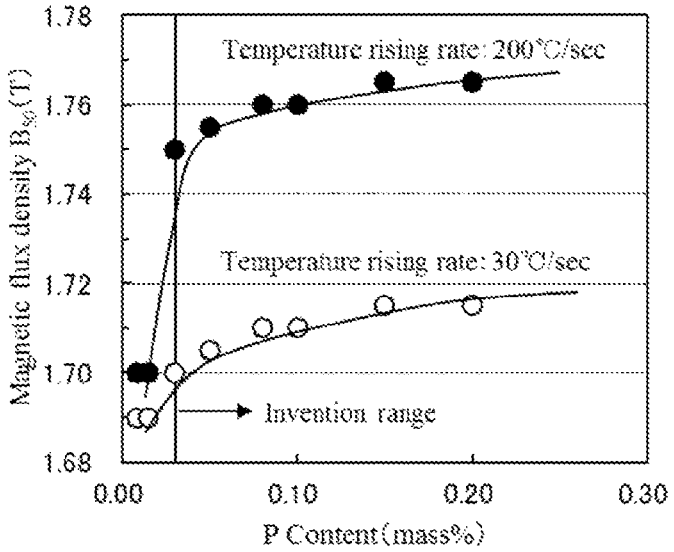
FIG. 1 is a graph showing an influence of P content upon magnetic flux density $B_{50}$.
Figure 2:
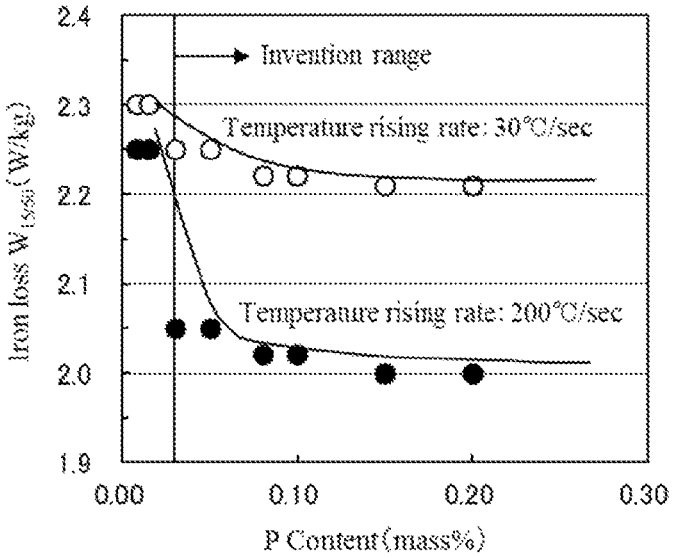
FIG. 2 is a graph showing an influence of P content upon iron loss $W_{15/50}$.

A L-direction sample of L: 180 mm×C: 30 mm and a C-direction sample of L: 30 mm×C: 180 mm are taken out from the thus obtained cold rolled, annealed steel sheets, and magnetic properties (magnetic flux density $B_{50}$, iron loss $W_{15/50}$) thereof are measured by an Epstein test to obtain results shown in FIGS. 1 and 2.

As seen from FIGS. 1 and 2, good magnetic properties are obtained when the P content is not less than 0.03 mass % and the temperature rising rate is 200° C./s. This is considered due to the fact that P is added in an amount of not less than 0.03 mass % to increase {100}<012> orientation as an axis of easy magnetization and the temperature rising rate up to 740° C. during the finishing annealing is increased to enhance an accumulation degree into {100}<012> orientation and further {100}<012> orientation is grown at subsequent high-temperature annealing to obtain good magnetic properties.

Next, the following experiment is carried out in order to investigate an influence of Ca upon magnetic properties.

A steel slab containing C: 0.0028 mass %, Si: 3.3 mass %, Mn: 0.50 mass %, Al: 0.004 mass %, N: 0.0022 mass %, P: 0.08 mass %, S: 0.0024 mass % and Ca: content varied within a range of 0.0001-0.015 mass % is reheated at 1100° C. for 30 minutes and hot rolled to provide a hot rolled steel sheet of 1.8 mm in thickness, which is subjected to a hot band annealing of 1000° C.×30 seconds and to a single cold rolling to provide a cold rolled steel sheet of 0.25 mm in thickness. Then, the cold rolled steel sheet is subjected to a finishing annealing (recrystallization annealing) by heating in a direct-conducting heating furnace up to 740° C. at a temperature rising rate of two levels of 30° C./s and 300° C./s, further raising the temperature up to 1000° C. at 30° C./s, keeping this temperature for 10 seconds and thereafter cooling.

Figure 3:
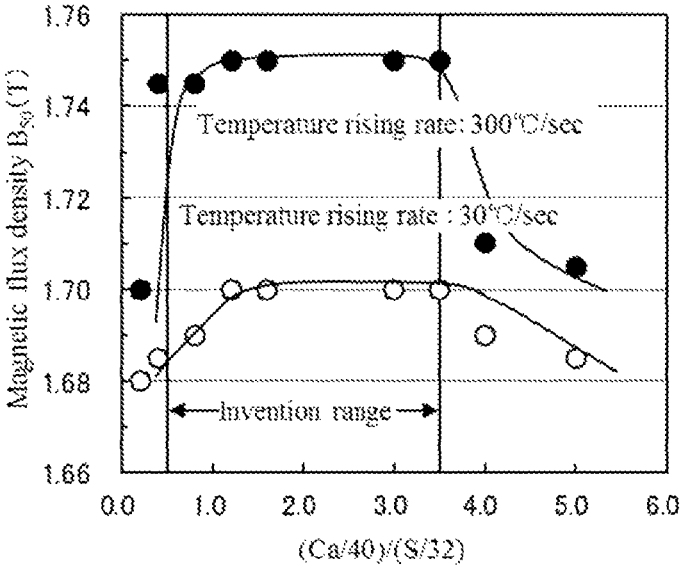
FIG. 3 is a graph showing an influence of Ca/S (atom ratio) upon magnetic flux density $B_{50}$.
Figure 4:
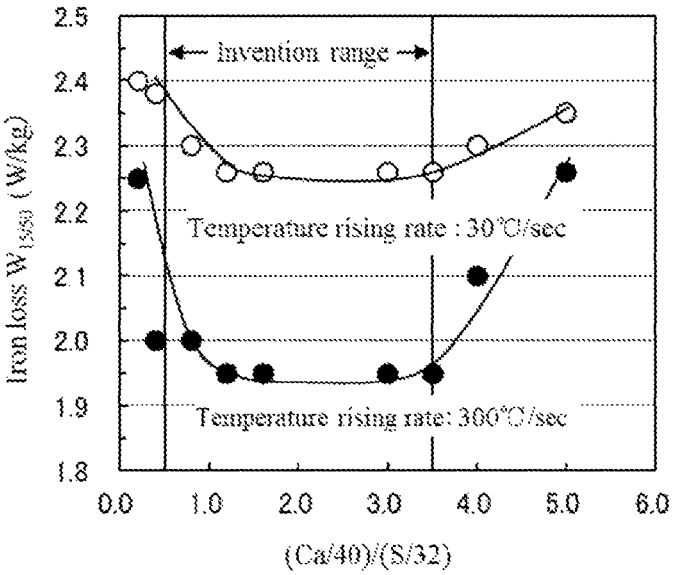
FIG. 4 is a graph showing an influence of Ca/S (atom ratio) upon iron loss $W_{15/50}$.

L-direction sample of L: 180 mm×C: 30 mm and C-direction sample of L: 30 mm×C: 180 mm are cut out from the thus obtained cold rolled, annealed steel sheets, and magnetic properties (magnetic flux density $B_{50}$, iron loss $W_{15/50}$) thereof are measured by an Epstein test to obtain results shown in FIGS. 3 and 4.

As seen from FIGS. 3 and 4, good magnetic properties are obtained when the atom ratio of Ca to S or ((Ca/40)/(S/32)) is within a range of 0.5-3.5 and the temperature rising rate is 300° C./s. This is considered due to the fact that since Ca has an effect of fixing S in steel to precipitate CaS, grain growth during the hot band annealing of hot rolled steel sheet is improved and crystal grain size before the cold rolling is coarsened to reduce {111}<112> orientation as a hardly-magnetizable axis in the recrystallized texture after the cold rolling and further that the temperature rising rate in the heating for finishing annealing (recrystallization annealing) is increased to more reduce {111}<112> orientation and consequently {100}<012> orientation as a magnetization easy axis is increased to obtain the significant improvement of the magnetic properties.

Then, the following experiment is carried out in order to investigate an influence of temperature rising rate upon the magnetic properties.

A steel slab containing C: 0.0025 mass %, Si: 2.5 mass %, Mn: 0.20 mass %, Al: 0.001 mass %, N: 0.0025 mass %, P: 0.10 mass %, S: 0.0020 mass % and Ca: 0.003 mass % is reheated at 1100° C. for 30 minutes and hot rolled to provide a hot rolled steel sheet of 1.8 mm in thickness, which is subjected to a hot band annealing of 1000° C.×30 seconds and to a single cold rolling to provide a cold rolled steel sheet of 0.30 mm in thickness. Then, the cold rolled steel sheet is subjected to a finishing annealing (recrystallization annealing) by variously changing a temperature rising rate in a direct-conducting heating furnace within a range of 30-300° C./s to heat up to 740° C., further raising the temperature up to 1020° C. at 30° C./s, keeping this temperature for 10 seconds and thereafter cooling.

Figure 5:
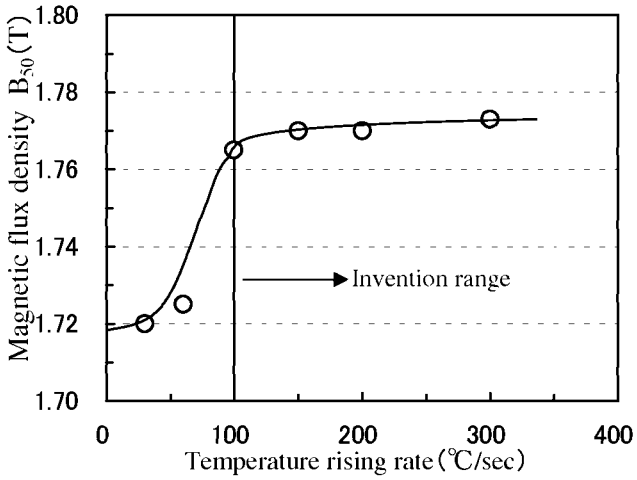
FIG. 5 is a graph showing an influence of temperature rising rate upon magnetic flux density $B_{50}$.
Figure 6:
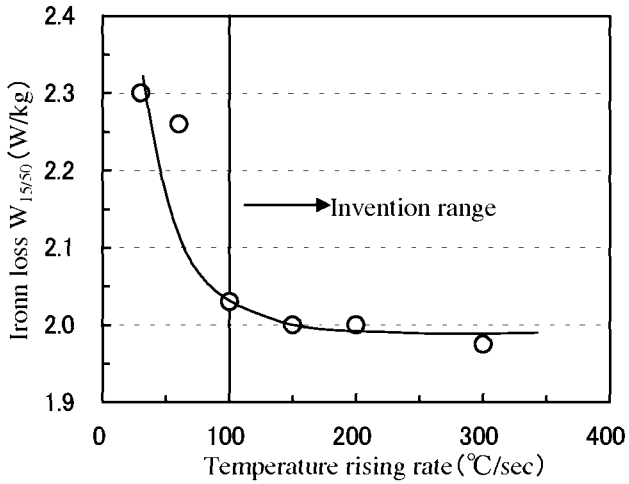
FIG. 6 is a graph showing an influence of temperature rising rate upon iron loss $W_{15/50}$.

A L-direction sample of L: 180 mm×C: 30 mm and a C-direction sample of L: 30 mm×C: 180 mm are taken out from the thus obtained cold rolled, annealed steel sheets, and magnetic properties (magnetic flux density $B_{50}$, iron loss $W_{15/50}$) thereof are measured by an Epstein test to obtain results shown in FIGS. 5 and 6.

As seen from FIGS. 5 and 6, the good magnetic properties are obtained when the temperature rising rate up to 740°C. is not less than 100° C./s. This is considered due to the fact that recrystallization of {111} grains is suppressed by increasing the temperature rising rate and recrystallization of {110} grains and {100} grains is promoted to improve the magnetic properties.

The invention is developed based on the above knowledge.

The chemical composition of the non-oriented electrical steel sheet of the invention will be described below.

C: not more than 0.005 mass %

When C is included in an amount exceeding 0.005 mass %, magnetic aging is caused to bring about the deterioration of iron loss property. Therefore, C content is not more than 0.005 mass %. Preferably, it is not more than 0.003 mass %.

Si: not more than 4 mass %

Si is added for increasing a specific resistance of steel to improve the iron loss, but when it is added in an amount exceeding 4 mass %, it is difficult to conduct rolling for the production. In the invention, therefore, the upper limit of Si is 4 mass %. Preferably, it is a range of 1-4 mass %.

Mn: 0.03-3 mass %

Mn is an element required for improving hot workability, but such an effect is not obtained when it is less than 0.03 mass %. On the other hand, the addition exceeding 3 mass % brings about the decrease of saturated magnetic flux density and the rise of raw materials cost. Therefore, Mn is a range of 0.03-3 mass %. Preferably, it is a range of 0.05-2 mass %.

Al: not more than 3 mass %

Al is added for increasing a specific resistance of steel to improve the iron loss likewise Si, but the addition exceeding 3 mass % deteriorates the rolling property. In the invention, therefore, the upper limit of Al is 3 mass %. Preferably, it is not more than 2 mass %. Moreover, Al may not be added positively.

P: 0.03-0.2 mass %

P has an effect of increasing {100}<012> orientation as a magnetization easy axis to improve the magnetic properties and is an essential addition element in the invention. This effect is obtained by the adding of not less than 0.03 mass % as shown in FIGS. 1 and 2 However, the addition exceeding 0.2 mass % obstructs the cold rolling property and is difficult to conduct rolling for the production. Therefore, P is a range of 0.03-0.2 mass %. Preferably, it is a range of 0.05-0.15 mass %.

S: not more than 0.005 mass %, N: not more than 0.005 mass %

S and N are incidental impurities incorporated into steel, and the inclusion exceeding 0.0050 mass % leads to the deterioration of the magnetic properties, so that each of them is limited to not more than 0.0050 mass %. Preferably, they are S: not more than 0.004 mass % and N: not more than 0.004 mass %.

Ca: 0.0005-0.01 mass % and (Ca mass %/40)/(S mass %/32): 0.5-3.5

Ca has an effect of fixing S to promote grain growth in the hot band annealing of the hot rolled steel sheet and coarsening crystal grain size before the cold rolling to reduce {111}<112> orientation in the recrystallized texture after the cold rolling. When the addition amount of Ca is less than 0.0005 mass %, the above effect is not sufficient, while when it exceeds 0.01 mass %, excessive precipitation of CaS is caused to undesirably increase hysteresis loss.

In order to surely obtain the above effect of Ca, it is necessary that in addition to the above chemical composition, the atom ratio of Ca to S ((Ca mass %/40)/(S mass %/32)) is within a range of 0.5-3.5. When the atom ratio of Ca to S is less than 0.5, the above effect is not obtained sufficiently, while when the atom ratio of Ca to S exceeds 3.5, the amount of CaS precipitated becomes too large and the hysteresis loss increases and the iron loss rather increases. Therefore, Ca is necessary to be added in the atom ratio to S within a range of 0.5-3.5. Preferably, it is a range of 1-3.

In addition to the above chemical composition, the non-oriented electrical steel sheet of the invention can further contain one or two of Sn: 0.003-0.5 mass % and Sb: 0.003-0.5 mass %.

Sn and Sb have various favorable effects of not only improving the texture to improve the magnetic flux density but also suppressing oxidation or nitriding on the surface layer of the steel sheet and the formation of finely-divided particles on the surface layer associated therewith to prevent the deterioration of the magnetic properties, and so on. In order to develop such effects, it is preferable to include one or more of Sn and Sb in an amount of not less than 0.003 mass %. On the other hand, the addition exceeding 0.5 mass % obstructs the growth of crystal grains and rather the deterioration of the magnetic properties is caused. Therefore, if it is intended to add Sn and Sb, each of them is preferable to be added within a range of 0.003-0.5 mass %. More preferably, the addition amount of each of them is a range of 0.005-0.4 mass %.

Moreover, the balance other than the above ingredients in the non-oriented electrical steel sheet of the invention is Fe and incidental impurities.

The production method of the non-oriented electrical steel sheet of the invention will be described below.

The non-oriented electrical steel sheet of the invention can be commonly produced by a well-known method wherein a steel having a chemical composition adjusted so as to be adapted to the invention is melted by a refining process using a convertor, an electric furnace, a vacuum degassing equipment or the like and shaped into a steel slab by a continuous casting method or an ingot making-slabbing method, and the resulting steel slab is hot rolled to provide a hot rolled steel sheet, which is subjected to a hot band annealing and thereafter cold rolled and then subjected to a recrystallization annealing (finishing annealing). Among the above production steps, production conditions up to the hot rolling step including the hot band annealing may be followed by the conventionally well-known conditions and are not particularly limited. Therefore, production conditions of the subsequent cold rolling step will be described below.

As the cold rolling for providing a cold rolled sheet with a final thickness from a hot rolled sheet after the hot band annealing of the hot rolled sheet may be adopted either a single cold rolling or two or more cold rollings including an intermediate annealing therebetween. Also, its rolling reduction may be the same as in the usual production process of the non-oriented electrical steel sheet.

Subsequently, the cold rolled steel sheet is subjected to a finishing annealing (recrystallization annealing). In the production method of the invention, it is necessary to rapidly heat the sheet up to a recrystallization temperature region as a heating condition in the finishing annealing. Concretely, it is necessary to conduct the rapid heating from room temperature to 740°C. at an average heating rate of not less than 100° C./s. As shown in FIGS. 5 and 6, recrystallization of {111} grains is suppressed and recrystallization of {110} grains or {100} grains is promoted by rapidly heating at 100° C./s or more, and hence the magnetic properties are improved. Preferably, the heating rate from room temperature to 740° C. is not less than 150° C./s.

Moreover, an end temperature of the rapid heating is sufficient to be 740° C., which is a temperature of at least completing the recrystallization, but it may be a temperature exceeding 740° C. However, as the end temperature becomes higher, an equipment cost required for heating or a running cost increases, so that the higher end temperature is not favorable in view of the production cost. In the invention, therefore, the end temperature for the rapid heating is at least 740° C.

Then, the cold rolled steel sheet recrystallized by the rapid heating is subjected to a soaking annealing by further raising the temperature for growing the grains into a given crystal grain size. In this case, the temperature rising rate, soaking temperature and soaking time may be made according to the usual annealing conditions used in the non-oriented electrical steel sheet, and are not particularly limited. For example, it is preferable that the temperature rising rate up to the soaking temperature above 740° C. is 1-50° C./s, and the soaking temperature is 800-1100° C., and the soaking time is 5-120 seconds. More preferably, the soaking temperature is 900-1050° C.

Moreover, the method of rendering the temperature rising rate during the above heating into not less than 100° C./s is not particularly limited, so that a direct electricity heating method, an induction heating method or the like can be preferably used.

EXAMPLES

A steel slab is prepared by melting steel of a chemical composition shown in Table 1, reheated at 1080° C. for 30 minutes, hot rolled to a thickness of 2.0 mm, hot band annealed at 1000° C. for 30 seconds and then subjected to a single cold rolling to provide a cold rolled steel sheet having a final thickness t shown in Table 2.

Next, the sheet is subjected to such a finishing annealing (recrystallization annealing) that it is heated in a direct electricity heating furnace by variously changing a temperature rising rate and an end temperature for rapid heating as shown in Table 2, and thereafter heated at 30° C./s up to a soaking temperature shown in Table 2, and kept at the same temperature for 10 seconds and then cooled, whereby a cold rolled, annealed steel sheet is obtained.

From the thus cold rolled, annealed steel sheet are cut out a L-direction sample of L: 180 mm×C: 30 mm and a C-direction sample of C: 180 mm×L: 30 mm, and their magnetic properties (magnetic flux density $B_{50}$, iron loss $W_{15/50}$) are measured by an Epstein test to obtain results also shown in Table 2.

As seen from Tables 1 and 2, non-oriented electrical steel sheets produced so as to satisfy all conditions of the invention have excellent magnetic properties in which the magnetic flux density is high and the iron loss is low. In Table 2, the steel sheet No. 5 is high in the P content and the steel sheet No. 18 is high in the Si content, so that the cracking or breakage is caused in the cold rolling and hence they cannot be transmitted to subsequent steps. In these tables, "tr" refers to a trace amount.

TABLE 1

| Steel | Chemical composition ( mass %) | | | | | | | | | | (Ca/40)/ | |
|---|---|---|---|---|---|---|---|---|---|---|---|---|
| No | C | Si | Mn | Al | S | N | Ca | P | Sn | Sb | (S/32) | Remarks |
| 1 | 0.0025 | 3.0 | 0.50 | 0.001 | 0.0015 | 0.0021 | 0.0025 | 0.02 | tr. | tr. | 1.3 | Comparative Example |
| 2 | 0.0025 | 3.0 | 0.50 | 0.001 | 0.0015 | 0.0021 | 0.0025 | 0.04 | tr. | tr. | 1.3 | Example |
| 3 | 0.0025 | 3.0 | 0.50 | 0.001 | 0.0015 | 0.0021 | 0.0025 | 0.10 | tr. | tr. | 1.3 | Example |
| 4 | 0.0025 | 3.0 | 0.50 | 0.001 | 0.0015 | 0.0021 | 0.0025 | 0.20 | tr. | tr. | 1.3 | Example |
| 5 | 0.0025 | 3.0 | 0.50 | 0.001 | 0.0015 | 0.0021 | 0.0025 | 0.25 | tr. | tr. | 1.3 | Comparative Example |
| 6 | 0.0028 | 3.3 | 0.08 | 0.003 | 0.0024 | 0.0021 | 0.0012 | 0.10 | tr. | tr. | 0.4 | Comparative Example |
| 7 | 0.0028 | 3.3 | 0.08 | 0.003 | 0.0024 | 0.0021 | 0.0018 | 0.10 | tr. | tr. | 0.6 | Example |
| 8 | 0.0028 | 3.3 | 0.08 | 0.003 | 0.0024 | 0.0021 | 0.0035 | 0.10 | tr. | tr. | 1.2 | Example |
| 9 | 0.0028 | 3.3 | 0.08 | 0.003 | 0.0024 | 0.0021 | 0.0090 | 0.10 | tr. | tr. | 3.0 | Example |
| 10 | 0.0028 | 3.3 | 0.08 | 0.003 | 0.0024 | 0.0021 | 0.0120 | 0.10 | tr. | tr. | 4.0 | Comparative Example |
| 11 | 0.0025 | 2.5 | 0.10 | 0.002 | 0.0015 | 0.0021 | 0.0020 | 0.10 | tr. | tr. | 1.1 | Comparative Example |
| 12 | 0.0025 | 2.5 | 0.10 | 0.002 | 0.0015 | 0.0021 | 0.0020 | 0.10 | tr. | tr. | 1.1 | Comparative Example |
| 13 | 0.0025 | 2.5 | 0.10 | 0.002 | 0.0015 | 0.0021 | 0.0020 | 0.10 | tr. | tr. | 1.1 | Example |
| 14 | 0.0025 | 2.5 | 0.10 | 0.002 | 0.0015 | 0.0021 | 0.0020 | 0.10 | tr. | tr. | 1.1 | Example |
| 15 | 0.0035 | 1.0 | 0.06 | 2.0 | 0.0022 | 0.0025 | 0.0035 | 0.06 | tr. | tr. | 1.3 | Example |
| 16 | 0.0035 | 2.0 | 0.06 | 1.0 | 0.0025 | 0.0022 | 0.0035 | 0.08 | tr. | tr. | 1.1 | Example |
| 17 | 0.0030 | 3.7 | 0.07 | 0.004 | 0.0025 | 0.0021 | 0.0036 | 0.05 | tr. | tr. | 1.2 | Example |
| 18 | 0.0030 | 4.5 | 0.15 | 0.001 | 0.0017 | 0.0023 | 0.0026 | 0.08 | tr. | tr. | 1.2 | Comparative Example |
| 19 | 0.0030 | 3.0 | 0.50 | 0.5 | 0.0015 | 0.0021 | 0.0028 | 0.10 | tr. | tr. | 1.5 | Example |
| 20 | 0.0025 | 2.5 | 0.10 | 1.0 | 0.0034 | 0.0033 | 0.0060 | 0.10 | tr. | tr. | 1.4 | Example |
| 21 | 0.0035 | 2.0 | 0.50 | 1.5 | 0.0022 | 0.0016 | 0.0020 | 0.10 | tr. | tr. | 0.7 | Example |
| 22 | 0.0025 | 1.0 | 0.06 | 2.5 | 0.0021 | 0.0019 | 0.0025 | 0.10 | tr. | tr. | 1.0 | Example |
| 23 | 0.0030 | 3.0 | 0.50 | 3.5 | 0.0015 | 0.0021 | 0.0021 | 0.10 | tr. | tr. | 1.1 | Comparative Example |
| 24 | 0.0035 | 2.0 | 1.0 | 0.001 | 0.0030 | 0.0026 | 0.0030 | 0.07 | tr. | tr. | 0.8 | Example |
| 25 | 0.0040 | 1.5 | 2.5 | 0.001 | 0.0015 | 0.0021 | 0.0022 | 0.07 | tr. | tr. | 1.2 | Example |
| 26 | 0.0025 | 2.5 | 4.0 | 0.001 | 0.0021 | 0.0019 | 0.0025 | 0.10 | tr. | tr. | 1.0 | Comparative Example |
| 27 | 0.0030 | 3.0 | 0.15 | 0.002 | 0.0090 | 0.0015 | 0.0100 | 0.10 | tr. | tr. | 0.9 | Comparative Example |
| 28 | 0.0025 | 3.0 | 0.15 | 0.002 | 0.0019 | 0.0080 | 0.0030 | 0.07 | tr. | tr. | 1.3 | Comparative Example |
| 29 | 0.0025 | 3.0 | 0.50 | 0.001 | 0.0015 | 0.0021 | 0.0020 | 0.04 | 0.80 | tr. | 1.1 | Comparative Example |
| 30 | 0.0025 | 3.0 | 0.50 | 0.002 | 0.0015 | 0.0021 | 0.0020 | 0.15 | tr. | 0.70 | 1.1 | Comparative Example |
| 31 | 0.0025 | 3.0 | 0.50 | 0.002 | 0.0015 | 0.0021 | 0.0020 | 0.10 | 0.005 | tr. | 1.1 | Example |
| 32 | 0.0025 | 3.0 | 0.50 | 0.002 | 0.0015 | 0.0021 | 0.0020 | 0.10 | 0.040 | tr. | 1.1 | Example |
| 33 | 0.0025 | 3.0 | 0.50 | 0.002 | 0.0015 | 0.0021 | 0.0020 | 0.10 | 0.10 | tr. | 1.1 | Example |
| 34 | 0.0025 | 3.0 | 0.50 | 0.002 | 0.0015 | 0.0021 | 0.0020 | 0.10 | 0.40 | tr. | 1.1 | Example |
| 35 | 0.0025 | 3.0 | 0.50 | 0.002 | 0.0015 | 0.0021 | 0.0020 | 0.10 | tr. | 0.005 | 1.1 | Example |
| 36 | 0.0025 | 3.0 | 0.50 | 0.002 | 0.0015 | 0.0021 | 0.0020 | 0.10 | tr. | 0.040 | 1.1 | Example |
| 37 | 0.0025 | 3.0 | 0.50 | 0.002 | 0.0015 | 0.0021 | 0.0020 | 0.10 | tr. | 0.10 | 1.1 | Example |
| 38 | 0.0025 | 3.0 | 0.50 | 0.002 | 0.0015 | 0.0021 | 0.0020 | 0.10 | tr. | 0.40 | 1.1 | Example |
| 39 | 0.0025 | 3.3 | 0.50 | 0.001 | 0.0015 | 0.0019 | 0.0020 | 0.10 | 0.040 | 0.040 | 1.1 | Example |
| 40 | 0.0025 | 3.0 | 0.50 | 0.001 | 0.0015 | 0.0021 | 0.0025 | 0.10 | tr. | tr. | 1.3 | Example |
| 41 | 0.0025 | 3.0 | 0.50 | 0.001 | 0.0015 | 0.0021 | 0.0025 | 0.10 | tr. | tr. | 1.3 | Example |
| 42 | 0.0025 | 3.3 | 0.10 | 0.001 | 0.0021 | 0.0021 | 0.0031 | 0.09 | 0.040 | tr. | 1.2 | Example |
| 43 | 0.0025 | 3.5 | 0.10 | 0.001 | 0.0018 | 0.0022 | 0.0033 | 0.07 | 0.040 | tr. | 1.5 | Example |
| 44 | 0.0025 | 3.7 | 0.10 | 0.001 | 0.0022 | 0.0026 | 0.0028 | 0.05 | 0.040 | tr. | 1.0 | Example |
| 45 | 0.0025 | 3.5 | 0.50 | 0.50 | 0.0020 | 0.0028 | tr. | 0.03 | tr. | tr. | 0 | Comparative Example |

TABLE 2

| | Recrystallization annealing conditions | | | | | Magnetic properties | | |
|---|---|---|---|---|---|---|---|---|
| Steel No | Temperature rising rate (C. °/sec) | Rapid heating end temperature (C. °) | Soaking temperature (C. °) | (Ca/40)/(S/32) | Thickness t (mm) | Magnetic flux density $B_{50}$ ( T) | Iron loss $W_{15/50}$ (W/kg) | Remarks |
| 1 | 300 | 740 | 990 | 1.3 | 0.35 | 1.69 | 2.30 | Comparative example |
| 2 | 250 | 740 | 990 | 1.3 | 0.35 | 1.75 | 2.00 | Example |
| 3 | 250 | 740 | 990 | 1.3 | 0.35 | 1.76 | 2.00 | Example |
| 4 | 200 | 740 | 990 | 1.3 | 0.35 | 1.76 | 2.00 | Example |
| 5 | — | — | — | 1.3 | — | — | — | Comparative example |
| 6 | 300 | 760 | 960 | 0.4 | 0.35 | 1.68 | 2.40 | Comparative example |
| 7 | 300 | 740 | 980 | 0.6 | 0.35 | 1.75 | 2.00 | Example |
| 8 | 300 | 750 | 1000 | 1.2 | 0.35 | 1.76 | 2.00 | Example |
| 9 | 300 | 740 | 1000 | 3.0 | 0.35 | 1.75 | 2.05 | Example |
| 10 | 300 | 740 | 1000 | 4.0 | 0.35 | 1.69 | 2.35 | Comparative example |
| 11 | 30 | 740 | 1050 | 1.1 | 0.35 | 1.70 | 2.40 | Comparative example |
| 12 | 80 | 770 | 1000 | 1.1 | 0.35 | 1.71 | 2.40 | Comparative example |
| 13 | 150 | 780 | 1000 | 1.1 | 0.35 | 1.77 | 2.00 | Example |
| 14 | 300 | 740 | 1000 | 1.1 | 0.35 | 1.77 | 2.00 | Example |
| 15 | 300 | 740 | 980 | 1.3 | 0.35 | 1.76 | 2.05 | Example |
| 16 | 250 | 740 | 980 | 1.1 | 0.35 | 1.76 | 2.05 | Example |
| 17 | 200 | 740 | 1020 | 1.2 | 0.35 | 1.75 | 1.90 | Example |
| 18 | — | — | — | 1.2 | — | — | — | Comparative example |
| 19 | 250 | 760 | 960 | 1.5 | 0.35 | 1.76 | 2.00 | Example |
| 20 | 200 | 750 | 1000 | 1.4 | 0.35 | 1.76 | 2.00 | Example |
| 21 | 300 | 740 | 1000 | 0.7 | 0.35 | 1.76 | 2.00 | Example |
| 22 | 250 | 740 | 1000 | 1.0 | 0.35 | 1.76 | 2.00 | Example |
| 23 | 200 | 750 | 960 | 1.1 | 0.35 | 1.70 | 2.20 | Comparative example |
| 24 | 300 | 740 | 1000 | 0.8 | 0.35 | 1.77 | 2.05 | Example |
| 25 | 300 | 740 | 1050 | 1.2 | 0.35 | 1.76 | 2.05 | Example |
| 26 | 250 | 740 | 1000 | 1.0 | 0.35 | 1.68 | 2.30 | Comparative example |
| 27 | 250 | 750 | 1000 | 0.9 | 0.35 | 1.68 | 2.50 | Comparative example |
| 28 | 300 | 740 | 1000 | 1.3 | 0.35 | 1.67 | 2.40 | Comparative example |
| 29 | 250 | 750 | 980 | 1.1 | 0.35 | 1.70 | 2.40 | Comparative example |
| 30 | 250 | 740 | 980 | 1.1 | 0.35 | 1.69 | 2.50 | Comparative example |
| 31 | 250 | 740 | 980 | 1.1 | 0.35 | 1.76 | 1.95 | Example |
| 32 | 250 | 740 | 980 | 1.1 | 0.35 | 1.76 | 1.95 | Example |
| 33 | 250 | 740 | 980 | 1.1 | 0.35 | 1.76 | 1.95 | Example |
| 34 | 250 | 740 | 980 | 1.1 | 0.35 | 1.76 | 1.95 | Example |
| 35 | 250 | 740 | 980 | 1.1 | 0.35 | 1.76 | 1.95 | Example |
| 36 | 250 | 740 | 980 | 1.1 | 0.35 | 1.76 | 1.95 | Example |
| 37 | 250 | 740 | 980 | 1.1 | 0.35 | 1.76 | 1.95 | Example |
| 38 | 250 | 740 | 980 | 1.1 | 0.35 | 1.76 | 1.95 | Example |
| 39 | 300 | 740 | 990 | 1.1 | 0.35 | 1.77 | 1.95 | Example |
| 40 | 250 | 740 | 990 | 1.3 | 0.25 | 1.76 | 1.90 | Example |
| 41 | 250 | 740 | 990 | 1.3 | 0.20 | 1.76 | 1.80 | Example |
| 42 | 300 | 740 | 1000 | 1.2 | 0.30 | 1.78 | 1.85 | Example |
| 43 | 300 | 740 | 1000 | 1.5 | 0.30 | 1.77 | 1.80 | Example |
| 44 | 300 | 740 | 1020 | 1.0 | 0.30 | 1.77 | 1.75 | Example |
| 45 | 200 | 740 | 950 | 0 | 0.35 | 1.69 | 2.30 | Comparative example |

The invention claimed is:

1. A method of producing a non-oriented electrical steel sheet, which comprises:

hot rolling a steel slab comprising C: not more than 0.005 mass %, Si: not more than 4 mass %, Mn: 0.03-3 mass %, Al: not more than 3 mass %, P: 0.03-0.2 mass %, S: present at not more than 0.005 mass %, N: not more than 0.005 mass %, Ca: 0.0005-0.01 mass %, provided that an atom ratio of Ca to S ((Ca mass %/40)/(S mass %/32)) is within a range of 1.4-3.0, and the balance being Fe and incidental impurities;

hot band annealing;

cold rolling; and then conducting recrystallization annealing by first heating at an average temperature rising rate of not less than 100° C/s up to 740° C., and then second heating at a temperature rising rate 1-50° C./s up to a soaking temperature of 800-1100° C., and then holding at the soaking temperature for 5 to 120 seconds.

2. The method of producing a non-oriented electrical steel sheet according to claim 1, wherein the steel slab further contains one or two selected from Sn and Sb in each amount of 0.003-0.5 mass %.

3. The method according to claim 1, wherein the S is present at not more than 0.004 mass %.

4. The method according to claim 1, wherein the average temperature rising rate in the first heating of the recrystallization annealing is not less than 150° C./s up to 740° C.

* * * * *